US009459552B2

(12) United States Patent
Endo

(10) Patent No.: US 9,459,552 B2
(45) Date of Patent: Oct. 4, 2016

(54) DRIVE CIRCUIT FOR PRINTING APPARATUS, LIGHT-EMITTING ELEMENT UNIT, AND PRINTING APPARATUS

(71) Applicant: CANON KABUSHIKI KAISHA, Tokyo (JP)

(72) Inventor: Wataru Endo, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/993,893

(22) Filed: Jan. 12, 2016

(65) Prior Publication Data

US 2016/0238964 A1 Aug. 18, 2016

(30) Foreign Application Priority Data

Feb. 12, 2015 (JP) ..... 2015-025618

(51) Int. Cl.
*G03G 15/04* (2006.01)
*G03G 15/00* (2006.01)
*G03G 15/043* (2006.01)

(52) U.S. Cl.
CPC ..... *G03G 15/04036* (2013.01); *G03G 15/043* (2013.01); *G03G 15/5004* (2013.01); *G03G 15/80* (2013.01)

(58) Field of Classification Search
CPC ..... G03G 15/04036; G03G 15/043; G03G 15/5004; G03G 15/80; G03G 2215/04; G03G 2215/0402; G03G 2215/0404; B41J 2/47; B41J 2/473; B02B 26/123
USPC ..... 399/4, 88, 82; 347/118, 224
See application file for complete search history.

(56) References Cited

U.S. PATENT DOCUMENTS 8,830,286 B2 9/2014 Toyoizumi et al. ..... 347/236
2013/0328992 A1* 12/2013 Hayakawa ..... G03G 15/80 347/224
2015/0116435 A1* 4/2015 Kawamoto ..... B41J 2/473 347/118
2015/0331352 A1* 11/2015 Motoyama ..... G03G 15/043 347/118

FOREIGN PATENT DOCUMENTS

JP 2013-007989 1/2013

* cited by examiner

*Primary Examiner* — Sophia S Chen
(74) *Attorney, Agent, or Firm* — Fitzpatrick, Cella, Harper and Scinto

(57) ABSTRACT

A drive circuit for a printing apparatus includes a first driver arranged on an electrical path from a first current supply unit to a first connection portion for a light-emitting element, a second driver arranged on an electrical path from a second current supply unit to the first connection portion, a third driver arranged on an electrical path from the second current supply unit to a second connection portion for a light-emitting element, and a switch unit configured to selectively connect the second current supply unit to one of the second driver and the third driver and disconnect the connection between the second current supply unit and the other of the second driver and the third driver when the second current supply unit is connected to the one of the second driver and the third driver.

25 Claims, 4 Drawing Sheets

DRIVE CIRCUIT FOR PRINTING APPARATUS, LIGHT-EMITTING ELEMENT UNIT, AND PRINTING APPARATUS

BACKGROUND OF THE INVENTION

1. Field of the Invention

The present invention relates to a drive circuit for a printing apparatus, a light-emitting element unit, and a printing apparatus.

2. Description of the Related Art

An electrophotographic printing apparatus (laser printer or the like) includes, for example, a photosensitive drum and a light-emitting element for irradiating the photosensitive drum with light. First, the photosensitive drum is charged and irradiated with light by the light-emitting element based on print data. From this operation, the potential of the portion irradiated with light decreases and a potential distribution is formed on the photosensitive drum based on the print data (latent image). Next, toner, which is a colored powder, is adhered to the photosensitive drum. The toner adheres to the photosensitive drum in accordance with the potential distribution on the photosensitive drum (developing). Subsequently, by transferring the toner adhered to the photosensitive drum to a printing medium such as paper or the like, an image according to the print data is formed on the printing medium.

The degradation of the photosensitive drum due to usage of the printing apparatus can change the potential of the photosensitive drum at the time of charging or the potential of a portion on the photosensitive drum which is irradiated with light, and a fog (a phenomenon in which a non-printing region becomes colored) or the like may be generated as a result. This can degrade the image quality. In order to prevent this, Japanese Patent Laid-Open No. 2013-7989 discloses how a light irradiation amount (first amount of light) to a portion on the photosensitive drum to which the toner is to be adhered and a light irradiation amount (second amount of light) to a portion on the photosensitive drum to which the toner is not to be adhered can be adjusted in accordance with the degree of the degradation of the photosensitive drum.

More specifically, according to Japanese Patent Laid-Open No. 2013-7989 (FIG. 5), a printing apparatus includes a light-emitting element 107, a monitor unit (light-receiving element 108) for monitoring the amount of light emitted from the light-emitting element, first current supply units 104 and 105, and second current supply units 114 and 115. For the portion on the photosensitive drum to which the toner is not to be adhered, a current Ib for small light emission is supplied from the second current supply units to the light-emitting element, and light irradiation is performed by using the second amount of light. For the portion on the photosensitive drum to which the toner is to be adhered, currents Idrv+Ib for printing are provided from the first and second current supply units to the light-emitting element, and light irradiation is performed with the first amount of light. The current Idrv of the first current supply units and the current Ib of the second current supply units are controlled based on the monitoring result by the monitor unit and the degree of the degradation of the photosensitive drum. This adjusts the first and second amounts of light. In this manner, according to Japanese Patent Laid-Open No. 2013-7989, the image quality is improved by controlling the respective current values of two kinds of currents, supplying the two kinds of currents to the light-emitting element, and performing printing in accordance with the degradation of the photosensitive drum.

Two current supply units are provided for each light-emitting element in the printing apparatus disclosed in Japanese Patent Laid-Open No. 2013-7989. This arrangement problematically results in a large circuit scale.

SUMMARY OF THE INVENTION

The present invention provides a novel technique for suppressing the circuit scale of a printing apparatus.

One of the aspects of the present invention provides a drive circuit for a printing apparatus, comprising a first driver arranged on an electrical path from a first current supply unit to a first connection portion for a light-emitting element, a second driver arranged on an electrical path from a second current supply unit to the first connection portion, a third driver arranged on an electrical path from the second current supply unit to a second connection portion for a light-emitting element, and a switch unit configured to selectively connect the second current supply unit to one of the second driver and the third driver and disconnect the connection between the second current supply unit and the other of the second driver and the third driver when the second current supply unit is connected to the one of the second driver and the third driver.

Further features of the present invention will become apparent from the following description of exemplary embodiments with reference to the attached drawings.

DESCRIPTION OF THE EMBODIMENTS

1. First Embodiment

1-1. Example of Arrangement of Printing Apparatus

Figure 1:
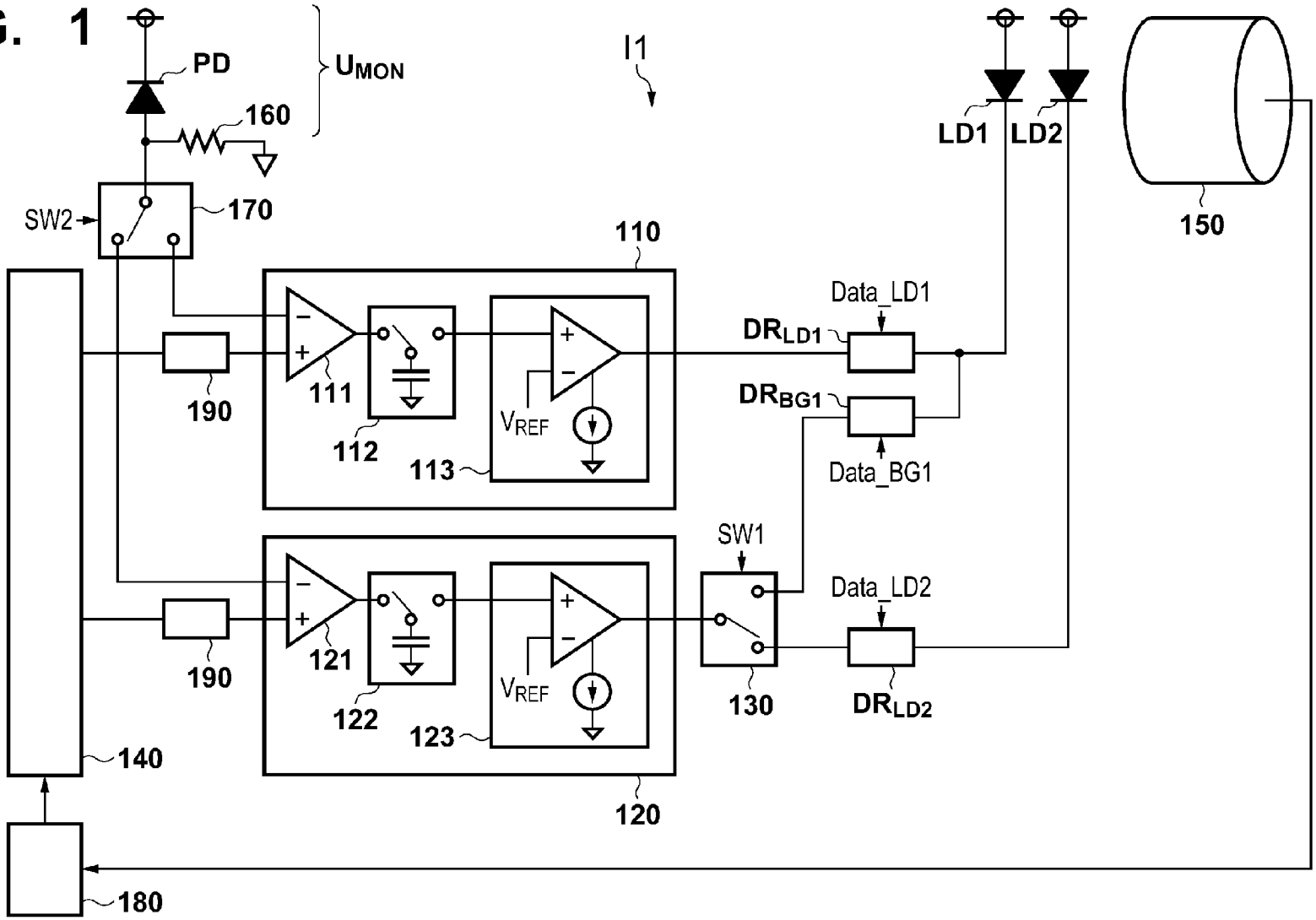
FIG. 1 a circuit diagram for explaining an example of the arrangement of a printing apparatus.

A printing apparatus I1 according to the first embodiment will be described with reference to FIG. 1. The printing apparatus I1 is an electrophotographic printing apparatus such as a laser printer or the like. The printing apparatus I1 includes a first light-emitting element LD1, a second light-emitting element LD2, a first driver $DR_{LD1}$, a second driver $DR_{BG1}$, a third driver $DR_{LD2}$, a first current supply unit 110, a second current supply unit 120, a switch unit 130, and a controller 140.

The light-emitting elements LD1 and LD2 each are, for example, a laser diode that emits light by receiving a current and irradiates a photosensitive drum 150 with the emitted light (laser).

The driver $DR_{LD1}$ is arranged on a path between the light-emitting element LD1 and the current supply unit 110. The node between the driver $DR_{LD1}$ and the light-emitting element LD1 is a connection portion to connect the driver $DR_{BG1}$. The driver $DR_{BG1}$ is arranged on a path between the light-emitting element LD1 and the current supply unit 120.

The driver $DR_{LD2}$ is arranged on a path between the light-emitting element LD2 and the current supply unit 120. The node between the driver $DR_{LD2}$ and the light-emitting element LD2 is a connection portion to connect the light-emitting element LD2.

The drivers $DR_{LD1}$, $DR_{BG1}$, and $DR_{LD2}$ are formed respectively by, for example, switch elements. The driver $DR_{LD1}$ is set in a conductive state upon receiving data Data_LD1 and supplies a current from the current supply unit 110 to the light-emitting element LD1. The driver $DR_{BG1}$ is set in a conductive state upon receiving data Data_BG1 and supplies a current from the current supply unit 120 to the light-emitting element LD1. The driver $DR_{LD2}$ is set in a conductive state upon receiving data Data_LD2 and supplies a current from the current supply unit 120 to the light-emitting element LD2. In other words, the drivers $DR_{LD1}$, $DR_{BG1}$, and $DR_{LD2}$ each drive a corresponding light-emitting element LD1 or LD2 based on the respective pieces of data Data_LD1, Data_BG1, and Data_LD2. Note that the data Data_LD1, Data_BG1, and Data_LD2 are print data and these data are generated based on print jobs, print conditions (for example, an operation mode), and the like.

In this embodiment, the current supply units 110 and 120, the drivers $DR_{LD1}$, $DR_{BG1}$, and $DR_{LD2}$ form a drive circuit for the printing apparatus I1. The drive circuit and the light-emitting element LD1 form a light-emitting element unit, and the light-emitting element unit can include, as an additional component, the light-emitting element LD2.

The switch unit 130 receives a control signal SW1 based on an operation mode from the controller 140 and connects either the driver $DR_{BG1}$ or the driver $DR_{LD2}$ with the current supply unit 120.

For example, in the first mode (corresponding to the high quality mode), the switch unit 130 electrically disconnects (cuts off) the current supply unit 120 and the driver $DR_{LD2}$ while electrically connecting the current supply unit 120 and the driver $DR_{BG1}$. In this state, when the driver $DR_{BG1}$ is set in a conductive state, the light-emitting element LD1 emits light upon receiving the current from the current supply unit 120. Additionally, when both of the drivers $DR_{LD1}$ and $DR_{BG1}$ are set in a conductive state, the light-emitting element LD1 emits light upon receiving a current obtained by adding the respective currents from the current supply unit 110 and the current supply unit 120. That is, whether the driver $DR_{BG1}$, out of the drivers $DR_{LD1}$ and $DR_{BG1}$, is set in a conductive state or both of the drivers $DR_{LD1}$ and $DR_{BG1}$ are set in a conductive state is selected based on the print data.

Also, for example, in the second mode (corresponding to the high-speed printing mode), the switch unit 130 disconnects the current supply unit 120 and the driver $DR_{BG1}$ while connecting the current supply unit 120 and the driver $DR_{LD2}$. In this state, when the driver $DR_{LD1}$ is set in a conductive state, the light-emitting element LD1 emits light upon receiving the current from the current supply unit 110. Additionally, when the driver $DR_{LD2}$ is set in a conductive state, the light-emitting element LD2 also emits light upon receiving the current from the current supply unit 120.

The printing apparatus I1 further includes a light-receiving element PD (light-receiving unit), a current-to-voltage converter 160, and a second switch unit 170. A current flows to the light-receiving element PD upon receiving the light from the light-emitting element LD1 and/or the light-emitting element LD2. The current that flows to the light-receiving element PD is converted into a voltage (to be referred to as a voltage $V_{MON}$) by the current-to-voltage converter 160. The current-to-voltage converter 160 includes a resistive element arranged on an electrical path between one terminal (the anode in this embodiment) of the light-receiving element PD and ground. When the current from the light-receiving element PD flows to ground via the resistance element, the voltage $V_{MON}$ corresponding to the current from the light-receiving element PD is generated in the node to which the above-described one terminal of the light-receiving element PD and the resistance element are connected. The switch unit 170 is controlled by a control signal SW2 from the controller 140. The voltage $V_{MON}$ is output to one of the current supply units 110 and 120 by the switch unit 170, and the current value of the current of the one of the current supply units 110 and 120 is adjusted based on the voltage $V_{MON}$.

In other words, the light-receiving element PD and the current-to-voltage converter 160 form a monitor unit $U_{MON}$ for monitoring the amounts of light emitted from the light-emitting elements LD1 and LD2. The controller 140 adjusts (or defines) the current value of the current supplied from the current supply unit 110 to the light-emitting element LD1 based on the monitoring result (that is, the voltage $V_{MON}$) of the monitor unit $U_{MON}$. Specifically (although the details will be described later), the voltage $V_{MON}$ is input to the current supply unit 110, and the current supply unit 110 adjusts the current value of the current to be supplied to the light-emitting element LD1 based on the voltage $V_{MON}$ and the signal from the controller 140. In the same manner, the controller 140 adjusts the current value of the current to be supplied to either the light-emitting element LD1 or LD2 from the current supply unit 120 based on the monitoring result (that is, the voltage $V_{MON}$) of the monitor unit $U_{MON}$.

Also, the printing apparatus I1 can further include, for example, a counter 180 for counting the degree of degradation of the photosensitive drum 150 such as a rotation count (cumulative rotation count, that is, the integrated value of the rotation count) of the photosensitive drum 150. The count value of the counter 180 is output to the controller 140.

In addition, the printing apparatus I1 can further include voltage generating units 190 that correspond respectively to the current supply units 110 and 120. Each voltage generating unit 190 is, for example, a digital-to-analog converter and generates a reference voltage $V_{COMP}$ (analog signal) for comparison based on a signal (digital signal) from the controller 140.

The current supply unit 110 includes, for example, a comparing unit 111, a holding unit 112, and a current output unit 113. The comparing unit 111 compares the voltage $V_{COMP}$ generated by the above-described voltage generating unit 190 and the voltage $V_{MON}$ of the above-described monitoring result. The holding unit 112 is, for example, a sample-and-hold circuit formed from a switch element and a capacitive element and holds the result of comparison by the comparing unit 111. The current output unit 113 includes, for example, a current amplifying circuit and a current supply source and outputs a current amount based on the information held by the holding unit 112.

The current supply unit 120 has the same arrangement as the current supply unit 110, and units 121 to 123 of the current supply unit 120 correspond to the units 111 to 113 of the current supply unit 110, respectively.

Auto power control (to be simply referred to as APC, hereinafter) of the printing apparatus I1 before the start of printing and the operation of the printing apparatus I1 at the time of printing will be described below. APC is an operation to cause the light-emitting elements LD1 and LD2 to emit light with a desired amount of light.

1-2. First Mode Operation of Printing Apparatus

The first mode (corresponding to the high quality mode) will be described first. In the first mode, printing on a printing medium is performed by driving the light-emitting element LD1 out of the light-emitting elements LD1 and LD2. In the first mode, the switch unit 130 connects the current supply unit 120 and the driver $DR_{BG1}$ and disconnects the current supply unit 120 and the driver $DR_{LD2}$.

APC is performed first. APC is performed before the start of printing, specifically, after one-scan light irradiation of the photosensitive drum 150 is completed but before the next one-scan light irradiation is started. For example, APC can be performed after printing of a predetermined number of printing media is completed but before starting the printing of the next predetermined number of printing media.

For example, the controller 140 supplies a signal corresponding to the count value (rotation count of the photosensitive drum 150 in this embodiment) of the counter 180 to the voltage generating unit 190 corresponding to the current supply unit 110. The voltage generating unit 190 generates the voltage $V_{COMP}$ corresponding to the signal and supplies the generated voltage $V_{COMP}$ to the comparing unit 111. On the other hand, the voltage $V_{MON}$ that is the monitoring result of the amount of light emitted from the light-emitting element LD1 is supplied to the comparing unit 111 by the switch unit 170. The comparing unit 111 compares the voltage $V_{MON}$ and the voltage $V_{COMP}$, and the holding unit 112 holds information corresponding to the comparison result of the comparing unit 111. The information, in other words, is information corresponding to the amount of light that has been emitted up to that point from the light-emitting element LD1 and the degree of degradation of the photosensitive drum 150 and is information for setting the amount of light to be emitted subsequently from the light-emitting element LD1.

The same operation as that of the current supply unit 110 is performed for the current supply unit 120. When printing is performed in the first mode (to be described later), a portion of the photosensitive drum 150 in which the conductivity is to be unchanged is irradiated by a small amount of light from the light-emitting element LD1. The current supply unit 120 accordingly supplies, to the light-emitting element LD1, a current to emit light with a small amount of light. Therefore, for the current supply unit 120, the signal supplied to the voltage generating unit 190 and the voltage (to be referred to as a voltage $V_{COMP}'$) generated by the voltage generating unit 190 in response to this are different from the above-described case of the current supply unit 110. Otherwise, the same operation as that of the current supply unit 110 is performed in the current supply unit 120.

In the above-described manner, APC is performed and the amount of light emitted from the light-emitting element LD1 when printing is to be performed later by the light-emitting element LD1 is adjusted.

Subsequently, when printing is performed, a current in an amount based on the information held by the holding unit 112 is supplied from the current supply unit 110 and a current in an amount based on the information held by the holding unit 122 is supplied from the current supply unit 120 to the light-emitting element LD1. Among the portions of photosensitive drum 150, the light-emitting element LD1 irradiates a portion in which the conductivity is to be changed with a light of the first amount of light and irradiates a portion in which the conductivity is to be unchanged with a light of the second amount of light. The first amount of light is an amount of light corresponding to the current amount obtained by adding the current amount (first current amount) from the current supply unit 110 and the current amount (second current amount) from the current supply unit 120. The second amount of light is an amount of light corresponding to the current amount from the current supply unit 120 that is a small amount of light smaller than the first amount of light. That is, a current in an amount obtained by adding the first current amount and the second current amount and a current of the second current amount are selectively supplied to the light-emitting element LD1 based on the print data.

According to the first mode, a "fog" and the like generated by the degradation (the potential change in the photosensitive drum 150 caused by degradation) of the photosensitive drum 150 can be prevented and the quality of an image can be improved.

Note that although a mode in which the voltage generating units 190 generate the voltage $V_{COMP}$ (or the voltage $V_{COMP}'$) corresponding to the rotation count of the photosensitive drum 150 has been exemplified, the generation of the voltage $V_{COMP}$ is not limited to this. That is, the voltage $V_{COMP}$ need only correspond to the degree of the degradation of the photosensitive drum 150, and the voltage $V_{COMP}$ need only be generated by using information or the like indicating this degree of degradation.

The photosensitive drum 150 can be formed so that the toner will adhere to a portion in which the conductivity has changed and not adhere to a portion in which the conductivity is unchanged. In other embodiments, the photosensitive drum 150 can be formed so that the toner will not adhere to the portion in which the conductivity has changed and adhere to the portion in which the conductivity is unchanged.

1-3. Second Operation Mode of Printing Apparatus

The second mode (corresponding to the high-speed printing mode) will be described next. The second mode is mainly different from the first mode in that both light-emitting elements LD1 and LD2 are driven. More specifically, the second mode is different from the first mode in that, among the portions of the photosensitive drum 150, the portion in which the toner is to be adhered is irradiated with light from one of the light-emitting elements LD1 and LD2 (the other is not used) and the portion in which the toner is not to be adhered is not irradiated with light. In the second mode, the switch unit 130 connects the current supply unit 120 and the driver $DR_{LD2}$ and disconnects the current supply unit 120 and the driver $DR_{BG1}$.

Although the current supply unit 120 supplies a current to the light-emitting element LD1 to cause the light-emitting element LD1 to emit light with a small amount of light (second amount of light) in the first mode, the current supply unit 120 supplies a current to the light-emitting element LD2 to cause the light-emitting element LD2 to emit light with an amount approximately the same as that of the light-emitting element LD1 in the second mode. Therefore, in APC of the second mode, the signal supplied from the controller 140 to the voltage generating unit 190 corresponding to the current supply unit 120 is mainly different from the case of the first mode. That is, the voltage value of the voltage $V_{COMP}'$ generated by the voltage generating unit 190 corresponding to the current supply unit 120 in the second mode is different from the voltage value of the voltage $V_{COMP}'$ of the first mode. Otherwise, the same operation as that of the first mode is performed for both of the current supply units 110 and 120.

In the above-described manner, APC is performed and the amounts of light emitted from the light-emitting elements LD1 and LD2 are adjusted when printing is to be subsequently performed by the light-emitting elements LD1 and LD2.

Subsequently, printing is started. As described above, when printing is performed, the portion on the photosensitive drum 150 to which the toner is to be adhered is irradiated with light from one of the light-emitting elements LD1 and LD2 and the portion in which the toner is not to be adhered is not irradiated with light (the light-emitting elements LD1 and LD2 are not driven). If the light-emitting element LD1 performs irradiation, the amount of light to irradiate the portion to which the toner is to be adhered is an amount of light that corresponds to the current amount from the current supply unit 110. If the light-emitting element LD2 performs irradiation, the amount of light corresponds to the current amount from the current supply unit 120. Note that if the electrical characteristics of the light-emitting element LD1 and the electrical characteristics of the light-emitting element LD2 are approximately the same, the current amount from the current supply unit 110 and the current amount from the current supply unit 120 are approximately the same in the second mode.

According to the second mode, printing of two rows (or two columns) can be performed in one-scan light irradiation and the printing speed can be increased.

1-4. Summary of First Embodiment

According to the printing apparatus I1, in the first mode corresponding to the high quality mode, two kinds of currents adjusted by APC are supplied by two corresponding drivers $DR_{LD1}$ and $DR_{BG1}$ to one light-emitting element LD1, and the light-emitting element LD1 is driven. The first mode allows printing to be performed in accordance with the degradation of the photosensitive drum and the image quality can be improved. Also, in the second mode corresponding to the high-speed printing mode, two kinds of currents adjusted by APC are supplied by two corresponding drivers $DR_{LD1}$ and $DR_{LD2}$ to two light-emitting elements LD1 and LD2, respectively, and the light-emitting elements LD1 and LD2 are driven. The second mode allows printing of two rows (or two columns) by one-scan light irradiation to be performed and the printing speed can be increased.

According to the first embodiment, the switch unit 130 is arranged between the current supply unit 120 and the driver $DR_{BG1}$ and between the current supply unit 120 and the driver $DR_{LD2}$. The switch unit 130 connects one of the drivers $DR_{BG1}$ and $DR_{LD2}$ to the current supply unit 120 in accordance with the operation mode (more specifically, upon receiving the control signal SW1 based on the operation mode from the controller 140). That is, the current supply unit 120 is shared between the drivers $DR_{BG1}$ and $DR_{LD2}$ and connected to one of them in accordance with the operation mode. Therefore, according to the first embodiment, the printing apparatus I1 that has the two above-described operation modes can be formed while suppressing the circuit scale.

The first embodiment is also advantageously applicable to a plurality of printing apparatuses having different specifications. For example, the printing apparatus I1 can have a fixed operation mode so that it will operate by only one of the two operation modes in accordance with the product to be applied. For example, for a certain product, the printing apparatus I1 can be configured to operate by only the first mode, and for another product, the printing apparatus I1 can be configured to operate by only the second mode. In this case, the control signal supplied to the switch unit 130 is fixed, and the connection between the current supply unit 120 and one of the drivers $DR_{BG1}$ and $DR_{LD2}$ is fixed. Therefore, the first embodiment is advantageous in terms of design and production.

Note that although the high quality mode and the high-speed printing mode were exemplified as the operation modes in the first embodiment, the printing apparatus I1 can further include other operation modes.

2. Second Embodiment

Figure 2:
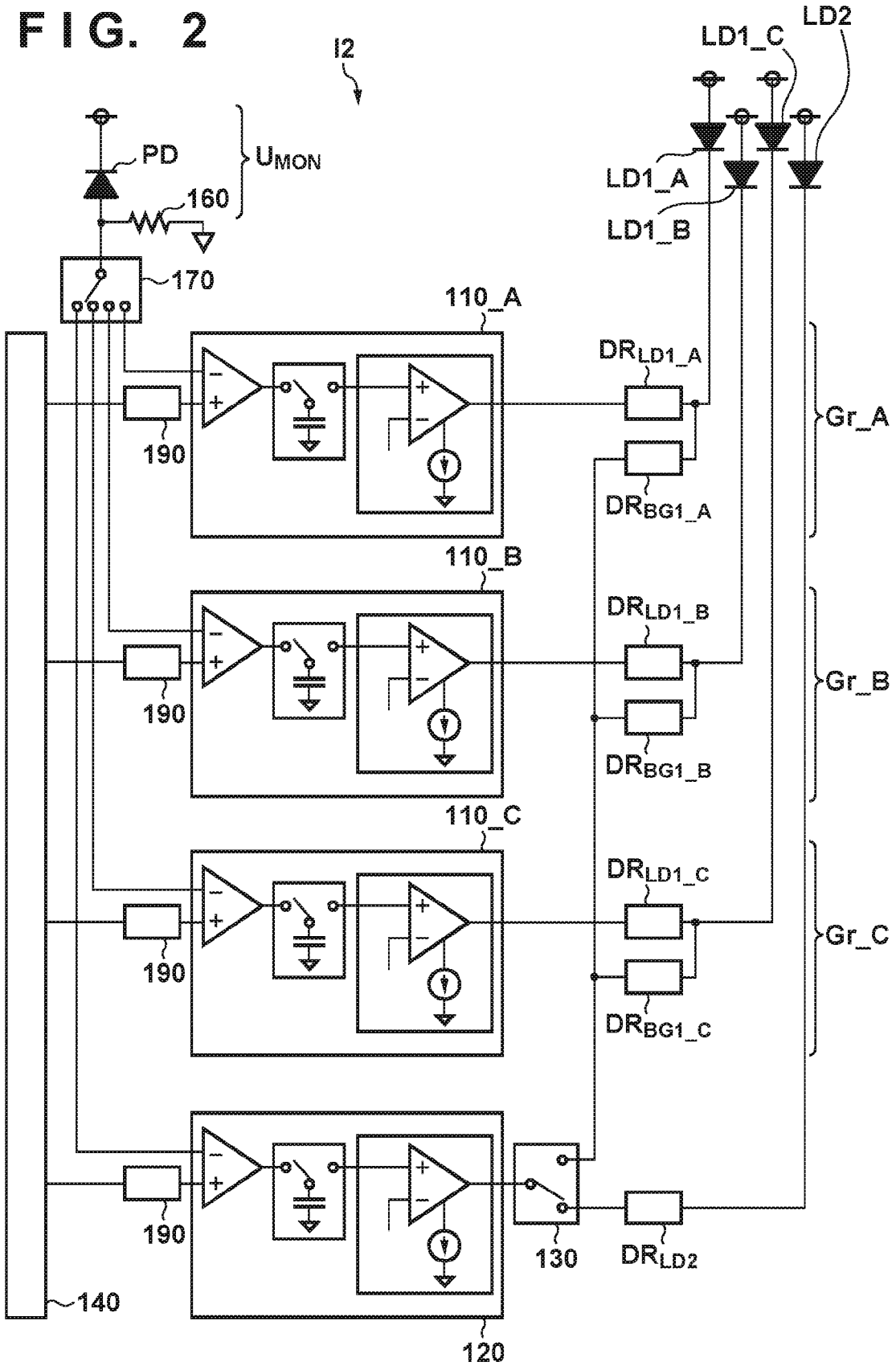
FIG. 2 is a circuit diagram for explaining an example of the arrangement of a printing apparatus.

The second embodiment will be described with reference to FIG. 2. A printing apparatus I2 according to the second embodiment includes a plurality of groups in which each group includes a light-emitting element LD1, a driver $DR_{LD1}$, a driver $DR_{BG1}$, and a current supply unit 110. According to the second embodiment, printing of a plurality of rows (or a plurality of columns) by one-scan light irradiation can be performed, and the printing speed for both of the first mode and the second mode can be improved.

The number of the groups will be three in this embodiment for the sake of clarity, and the three groups are groups Gr_A to Gr_C. Letters "A" to "C" are assigned respectively to the reference symbols that indicate units LD1 and the like which correspond to the respective groups Gr_A to Gr_C. For example, "LD1_A" denotes the light-emitting element LD1 of the group Gr_A. For example, "driver $DR_{LD1_B}$" denotes the driver $DR_{LD1}$ of the group Gr_B. The same denotation is also applied to other units.

In this arrangement, a switch unit 170 outputs each monitoring result (voltage $V_{MON}$) of the light emitting elements LD1_A, LD1_B, LD1_C, and LD2 to a corresponding one of the current supply units 110_A, 110_B, 110_C, and 120. In the subsequent printing operation, the light-emitting elements LD1_A to LD1_C and LD2 can be driven, for each operation mode, in the same manner as in the first embodiment. That is, in the first mode corresponding to the high quality mode, the light-emitting elements LD1_A to LD1_C are driven to perform printing, and in the second mode corresponding to the high-speed printing mode, the light-emitting elements LD1_A to LD1_C and LD2 are driven to perform printing.

According to the second embodiment, in addition to obtaining the same effects as those in the above-described first embodiment, the printing speed of both of the first mode and the second mode can be improved.

3. Third Embodiment

Figure 3:
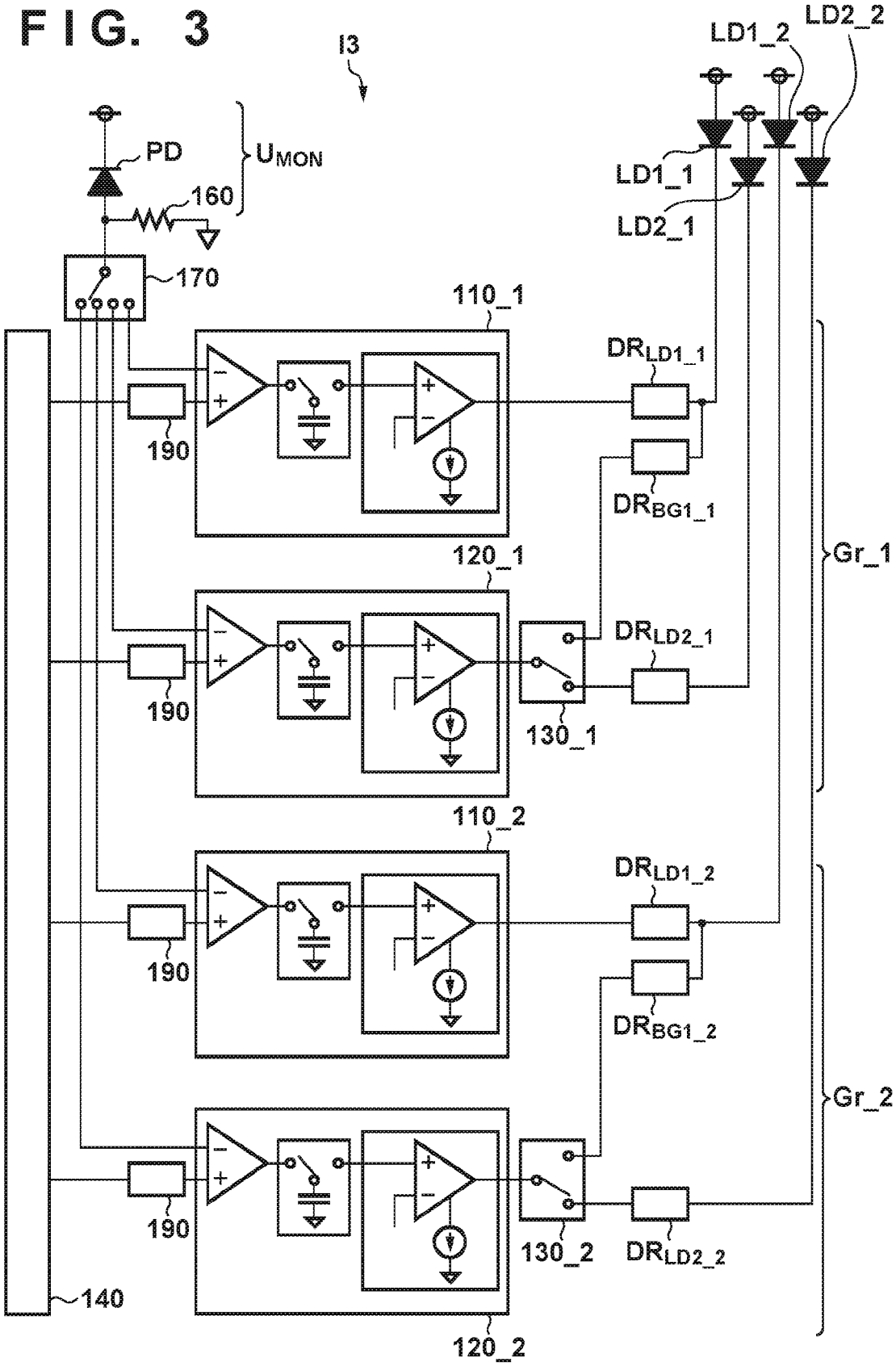
FIG. 3 is a circuit diagram for explaining an example of a printing apparatus.

The third embodiment will be described with reference to FIG. 3. A printing apparatus I3 according to the third embodiment includes a plurality of groups in which each group includes light-emitting elements LD1 and LD2, drivers $DR_{LD}$, $DR_{BG1}$, and $DR_{LD2}$, current supply units 110 and 120, and a switch unit 130. According to the third embodiment, as in the same manner as the above-described second embodiment, printing of a plurality of rows (or a plurality of columns) by one-scan light irradiation can also be performed, and the printing speed for both of the first mode and the second mode can be improved.

For illustrative convenience of the diagram, the number of groups will be two, and the two groups are groups Gr_1 and Gr_2, respectively. In the diagram, a number "1" or "2" is assigned to the reference symbols which indicate the units LD1 or the like that correspond to either the group Gr_1 or Gr_2. For example, "LD1_1" denotes the light-emitting element LD1 of the group Gr_1. For example, "switch unit 130_2" denotes the switch unit 130 of the group Gr_2. The same denotation is also applied to other units. Also, in the third embodiment, APC and the printing operation can be performed in the same manner as in the first embodiment for the respective groups Gr_1 and Gr_2.

Figure 4:
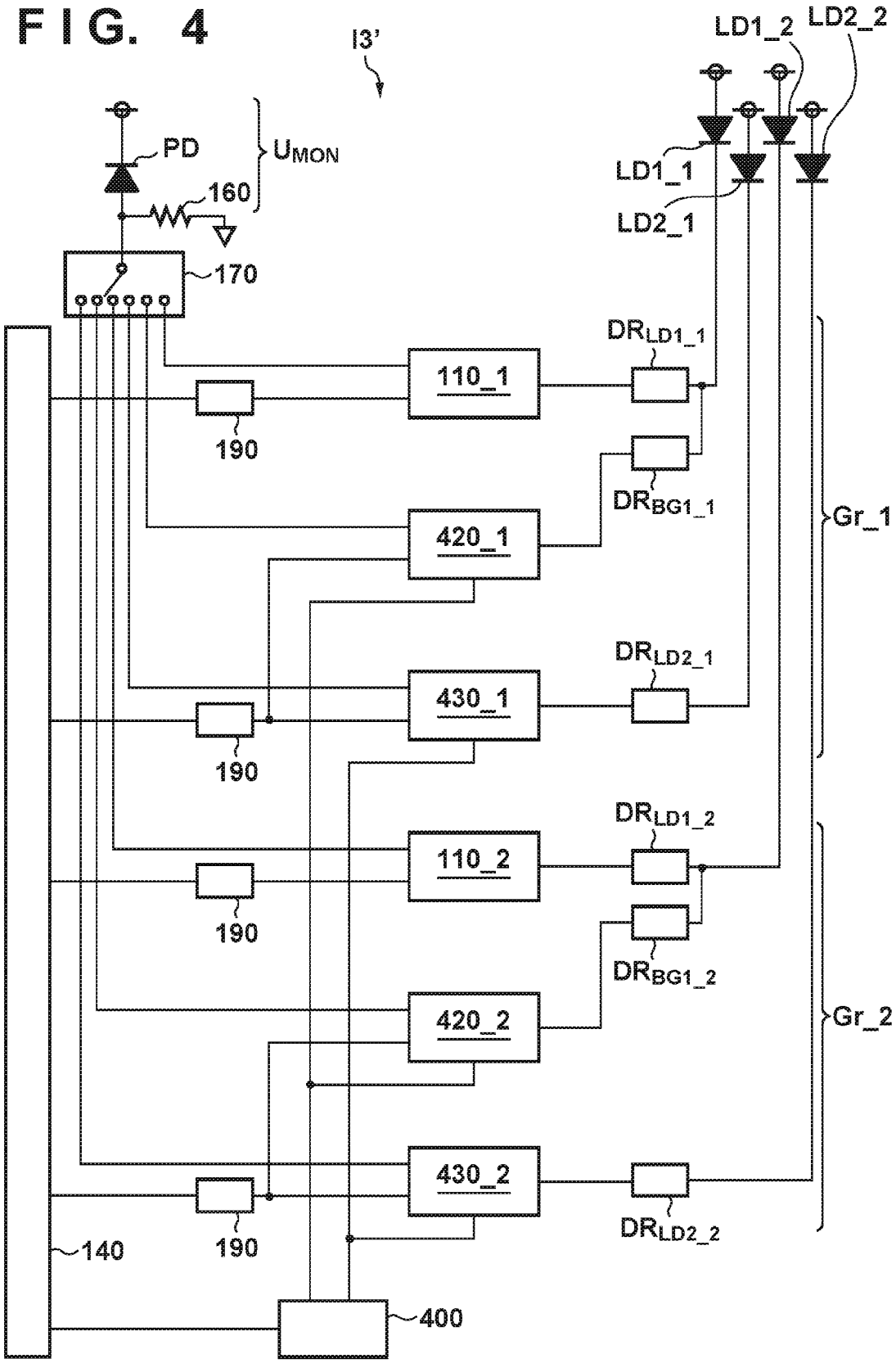
FIG. 4 is a circuit diagram for explaining an example of a printing apparatus.

FIG. 4 shows, as an application example of the third embodiment, an example of the arrangement of a printing apparatus I3'. The printing apparatus I3' includes, for example, for the group Gr_1, current supply units 420_1 and 430_1 instead of the current supply unit 120_1 and the switch unit 130_1. The current supply units 420_1 and 430_1 each have the same arrangement as the above-described current supply units 110 and 120 but further include a switch function of the switch unit 130_1. More specifically, the current supply units 420_1 and 430_1 each include the active mode and the inactive mode as the operation modes and can change the operation mode by receiving a predetermined control signal (for example, activation signal/inactivation signal, enable signal/disable signal, or the like). Each current supply unit supplies a current at the time of the active mode and does not supply current at the time of the inactive mode. The drive circuit for the printing apparatus of the third embodiment is formed by including at least the drivers $DR_{LD1}$, $DR_{BG1}$, $DR_{LD2}$, and the current supply units 110, 420_1, and 430_1.

The same arrangement is applicable to the group Gr_2, and the printing apparatus I3' further includes current supply units 420_2 and 430_2. The current supply units 420_2 and 430_2 correspond to the current supply units 420_1 and 430_1 of the group Gr_1, respectively.

The printing apparatus I3' further includes a setting unit 400. The setting unit 400 receives a control signal based on the operation mode from the controller 140 and supplies a control signal to set the respective current supply units 420_1 and the like to be in the active mode or the inactive mode. More specifically, in the first mode corresponding to the high quality mode, the current supply units 420_1 and 420_2 are set in the active mode and the current supply units 430_1 and 430_2 are set in the inactive mode. In the second mode corresponding to the high-speed printing mode, the current supply units 430_1 and the 430_2 are set in the active mode and the current supply units 420_1 and 420_2 are set in the inactive mode. Note that the setting unit 400 can be a part of the controller 140. Alternatively, the setting unit 400 can be included in the drive circuit for the printing apparatus.

According to this application example, two current supply units 420_1 and 430_1 (or 420_2 and 430_2) are separately provided to supply two different kinds of currents to the two light-emitting elements LD1_1 and LD2_1 (or LD1_2 and LD2_2), respectively. In this case, each of the two current supply units 420_1 and 430_1 (or 420_2 and 430_2) can be arranged to further include the switch function of a corresponding switch unit 130_1 (or 130_2). According to this application example, in the respective first and second modes, information for specifying the current value of the current to be supplied to the light-emitting unit LD1_1 or the like is separately held in the holding units of the corresponding current supply units 110, 420_1, and the like. Therefore, APC can be omitted when switching the operation mode.

4. Others

Although several preferable embodiments have been exemplified, the present invention is not limited to them. The embodiments may be partially changed in accordance with the purpose or the like, or respective features of the embodiments may be combined. For example, the functions of two or more units may be implemented by one unit or part of the function of a given unit may be implemented by another unit, and the arrangement of each unit can be changed in accordance with the purpose or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-025618, filed Feb. 12, 2015, which is hereby incorporated by reference herein in its entirety.

What is claimed is:

1. A drive circuit for a printing apparatus, comprising:
- a first driver arranged on an electrical path from a first current supply unit to a first connection portion for a light-emitting element;
- a second driver arranged on an electrical path from a second current supply unit to the first connection portion;
- a third driver arranged on an electrical path from the second current supply unit to a second connection portion for a light-emitting element; and
- a switch unit configured to selectively connect the second current supply unit to one of the second driver and the third driver and disconnect the connection between the second current supply unit and the other of the second driver and the third driver when the second current supply unit is connected to the one of the second driver and the third driver.

2. The circuit according to claim 1, wherein when the switch unit connects the second current supply unit to the second driver, the second current supply unit adjusts a current value of a current to be supplied, based on an integrated rotation count of a photosensitive drum.

3. The circuit according to claim 1, wherein when the switch unit connects the second current supply unit to the second driver, the first driver and the second driver selectively perform, based on print data, a first operation of adding a current from the first current supply unit and a current from the second current supply unit and supplying the added current to the first connection portion and a second operation of supplying the current from the second current supply unit to the first connection portion without supplying the current from the first current supply unit to the first connection portion.

4. The circuit according to claim 1, wherein when the switch unit connects the second current supply unit to the third driver, the second current supply unit supplies a current for changing the conductivity of a photosensitive drum.

5. The circuit according to claim 1, wherein the first current supply unit supplies a current for changing the conductivity of a photosensitive drum.

6. The circuit according to claim 1, further comprising:
- a monitor unit including a light-receiving unit and configured to input a signal from the light-receiving unit to at least one of the first current supply unit and the second current supply unit,
- wherein the at least one of the first current supply unit and the second current supply unit adjusts a current value of a current to be supplied, based on the signal from the light-receiving unit.

7. A drive circuit for a printing apparatus, comprising:

a first driver arranged on an electrical path from a first current supply unit to a first connection portion for a light-emitting element;

a second driver arranged on an electrical path from a second current supply unit to the first connection portion;

a third driver arranged on an electrical path from a third current supply unit to a second connection portion for a light-emitting element; and a controller configured to selectively activate one of the second current supply unit and the third current supply unit and inactivate the other of the second current supply unit and the third current supply unit when the one of the second current supply unit and the third current supply unit is activated.

8. The circuit according to claim 7, wherein when the controller activates the second current supply unit, the second current supply unit adjusts a current value of a current to be supplied, based on an integrated rotation count of a photosensitive drum.

9. The circuit according to claim 7, wherein when the controller activates the second current supply unit, the first driver and the second driver selectively perform, based on print data, a first operation of adding a current from the first current supply unit and a current from the second current supply unit and supplying the added current to the first connection portion and a second operation of supplying the current from the second current supply unit to the first connection portion without supplying the current from the first current supply unit to the first connection portion.

10. The circuit according to claim 7, wherein when the controller activates the third current supply unit, the third current supply unit supplies a current for changing the conductivity of a photosensitive drum.

11. The circuit according to claim 7, wherein the first current supply unit supplies a current for changing the conductivity of a photosensitive drum.

12. The circuit according to claim 7, further comprising:

a monitor unit including a light-receiving unit and configured to input a signal from the light-receiving unit to at least one of the first current supply unit, the second current supply unit, and the third current supply unit, wherein the at least one of the first current supply unit, the second current supply unit, and the third current supply unit adjusts a current value of a current to be supplied, based on the signal from the light-receiving unit.

13. The circuit according to claim 7, further comprising:

a first voltage generating unit configured to generate a voltage and output the generated voltage to the first current supply unit; and a second voltage generating unit configured to generate a voltage and output the generated voltage to both of the second current supply unit and the third current supply unit.

14. An electrophotographic printing apparatus comprising:

a first light-emitting element configured to irradiate a photosensitive drum with light;

a second light-emitting element configured to irradiate the photosensitive drum with light;

a first current supply unit configured to supply a current to the first light-emitting element;

a second current supply unit configured to supply a current to at least one of the first light-emitting element and the second light-emitting element;

a first driver arranged on an electrical path between the first light-emitting element and the first current supply unit;

a second driver arranged on an electrical path between the first light-emitting element and the second current supply unit;

a third driver arranged on an electrical path between the second light-emitting element and the second current supply unit; and a switch unit configured to selectively connect the second current supply unit to one of the second driver and the third driver and disconnect the connection between the second current supply unit and the other of the second driver and the third driver when the second current supply unit is connected to the one of the second driver and the third driver.

15. The apparatus according to claim 14, further comprising:

a controller;

wherein in a first mode, when the switch unit connects the second current supply unit and the second driver and disconnects the second current supply unit and the third driver, the controller controls, based on print data, the first driver and the second driver to selectively supply, to the first light-emitting element, a current obtained by adding the current from the first current supply unit and the current from the second current supply unit and the current from the second current supply unit, and in a second mode, when the switch unit disconnects the second current supply unit and the second driver and connects the second current supply unit and the third driver, the controller controls, based on print data, the first driver and the third driver to supply the current from the first current supply unit and the current from the second current supply unit to the first light-emitting element and the second light-emitting element, respectively.

16. The apparatus according to claim 15, further comprising:

a monitor unit configured to monitor the amounts of light emitted from the first light-emitting element and the second light-emitting element, wherein in the first mode, before start of printing, the controller sets a current value as a first current value by adjusting the current value of the current of the first current supply unit based on a monitoring result by the monitor unit and sets a current value as a second current value by adjusting the current value of the current of the second current supply unit based on the monitoring result by the monitor unit, and in the second mode, before the start of printing, the controller sets the respective current values of the currents of both of the first current supply unit and the second current supply unit to the first current value.

17. The apparatus according to claim 16, wherein when the controller is set in one of the first mode and the second mode, the first current supply unit supplies, to the first light-emitting element, the current of the first current value based on the print data, and when the controller is set in the first mode, the second current supply unit supplies, to the first light-emitting element, the current of the second current value based on the print data, and when the controller is set in the second mode, the second current supply unit supplies, to the second light-emitting element, the current of the first current value based on the print data.

18. The apparatus according to claim 16, wherein the controller sets, based on a degree of degradation of the photosensitive drum, the first current value and the second current value in the first mode and sets the first current value in the second mode.

19. The apparatus according to claim 16, wherein when the controller is set in the first mode, the first light-emitting element irradiates a portion on the photosensitive drum to which toner is to be adhered with an amount of light corresponding to an amount obtained by adding a first current amount and a second current amount and irradiates a portion on the photosensitive drum to which the toner is not to be adhered with an amount of light corresponding to the second current amount, and when the controller is set in the second mode, the first light-emitting element and the second light-emitting element irradiate the portion on the photosensitive drum to which the toner is to be adhered with the amount of light corresponding to the first current amount and do not irradiate the portion on the photosensitive drum to which the toner is not to be adhered.

20. The apparatus according to claim 16, wherein the controller sets, after completing given one-scan light irradiation to the photosensitive drum and before starting the next one-scan light irradiation, the first current value and the second current value in the first mode and sets the first current value in the second mode.

21. The apparatus according to claim 16, wherein the first current supply unit and the second current supply unit each include a comparing unit configured to compare a signal based on a degree of degradation of the photosensitive drum received from the controller and the monitoring result of the monitor unit, a holding unit configured to hold a comparison result by the comparing unit, and a current output unit configured to output a current amount based on information held in the holding unit.

22. The apparatus according to claim 21, further comprising:

a counter configured to count a rotation count of the photosensitive drum, wherein the signal based on the degree of degradation of the photosensitive drum corresponds to the rotation count of the photosensitive drum counted by the counter.

23. An electrophotographic printing apparatus, comprising:

a first light-emitting element configured to irradiate a photosensitive drum with light;

a second light-emitting element configured to irradiate the photosensitive drum with light;

a first current supply unit configured to supply a current to the first light-emitting element;

a second current supply unit configured to supply a current to the second light-emitting element;

a third current supply unit configured to supply a current to the first light-emitting element and different from the first current supply unit;

a first driver arranged on a path between the first light-emitting element and the first current supply unit;

a second driver arranged on a path between the second light-emitting element and the second current supply unit;

a third driver arranged on a path between the first light-emitting element and the third current supply unit; and a controller configured to selectively activate one of the second current supply unit and the third current supply unit and inactivate the other of the second current supply unit and the third current supply unit when the one of the second current supply unit and the third current supply unit is activated.

24. The apparatus according to claim 23, wherein in a first mode, when the third current supply unit is set in an active mode and the second current supply unit is set in an inactive mode, the controller controls, based on print data, the first driver and the second driver and selectively supplies, to the first light-emitting element, the current from the third current supply unit and a current obtained by adding the current from the first current supply unit and the current from the third current supply unit, and in a second mode, when the second current supply unit is set in the active mode and the third current supply unit is set in the inactive mode, the controller controls, based on print data, the first driver and the third driver and supplies the current from the first current supply unit and the current from the second current supply unit to the first light-emitting element and the second light-emitting element, respectively.

25. The apparatus according to claim 23, further comprising:

a first voltage generating unit configured to generate a voltage and output the generated voltage to the first current supply unit; and a second voltage generating unit configured to generate a voltage and output the generated voltage to both of the second current supply unit and the third current supply unit.

* * * * *